US009643046B1

(12) United States Patent
Kang

(10) Patent No.: US 9,643,046 B1
(45) Date of Patent: May 9, 2017

(54) DEVICE TO ASSIST WITH STRETCHING

(71) Applicant: Alan Xi Kang, Irvine, CA (US)

(72) Inventor: Alan Xi Kang, Irvine, CA (US)

( * ) Notice: Subject to any disclaimer, the term of this patent is extended or adjusted under 35 U.S.C. 154(b) by 0 days.

(21) Appl. No.: 15/233,589

(22) Filed: Aug. 10, 2016

(51) Int. Cl.

| | |
|---|---|
| ***A63B 21/002*** | (2006.01) |
| ***A63B 23/00*** | (2006.01) |
| ***A63B 21/00*** | (2006.01) |
| ***A61H 1/02*** | (2006.01) |
| ***A63B 23/02*** | (2006.01) |
| ***A63B 23/035*** | (2006.01) |

(52) U.S. Cl.
CPC ..... *A63B 23/00* (2013.01); *A61H 1/02* (2013.01); *A61H 1/0237* (2013.01); *A61H 1/0274* (2013.01); *A63B 21/00047* (2013.01); *A63B 21/4035* (2015.10); *A63B 23/02* (2013.01); *A63B 23/03516* (2013.01); *A63B 2023/006* (2013.01)

(58) Field of Classification Search
CPC ... A63B 23/00; A63B 23/02; A63B 2023/006; A63B 21/0047; A63B 21/4035; A63B 21/00047; A61H 1/02; A61H 1/0274; A61H 1/0237; Y10T 403/7094; Y10T 403/4694
USPC ..... 403/97, 359.6
See application file for complete search history.

(56) References Cited

U.S. PATENT DOCUMENTS

| | | | | |
|---|---|---|---|---|
| 2,855,198 | A * | 10/1958 | King | A63B 21/151 482/91 |
| 3,787,049 | A * | 1/1974 | Rellinger | A63B 21/068 482/142 |
| D352,614 | S * | 11/1994 | Adams | D6/339 |
| 6,203,473 | B1 | 3/2001 | Atwood | |
| 6,413,007 | B1 * | 7/2002 | Lambright | A47B 13/003 403/353 |
| 6,699,162 | B2 * | 3/2004 | Chen | A63B 21/4015 482/140 |
| 7,762,936 | B2 | 7/2010 | Conley et al. | |
| 8,216,114 | B1 * | 7/2012 | Wynn, III | A63B 23/0458 297/338 |
| 8,622,880 | B1 | 1/2014 | Collet | |
| 9,259,608 | B2 * | 2/2016 | Beck | A63B 23/04 |
| 2010/0290831 | A1 * | 11/2010 | Burnett | A47B 47/042 403/381 |
| 2012/0040809 | A1 | 2/2012 | Formicola | |
| 2012/0329623 | A1 * | 12/2012 | Ramirez | A63B 21/00047 482/139 |
| 2013/0225378 | A1 | 8/2013 | Burek | |

* cited by examiner

*Primary Examiner* — Loan H Thanh
*Assistant Examiner* — Megan Anderson

(57) ABSTRACT

A stretching device that facilitates wall-based stretching by creating a vertical surface for a user to press against. The stretching devices include two primary components: a stretching board and a base board. The stretching board can couple with the base board such that the stretching board and the base board form a right angle to each other. To use the device, the base board is placed flat on the ground with the stretching board sticking straight up. Stretching boards are designed to withstand forces of use without excess flexing.

10 Claims, 10 Drawing Sheets

FIG. 1E
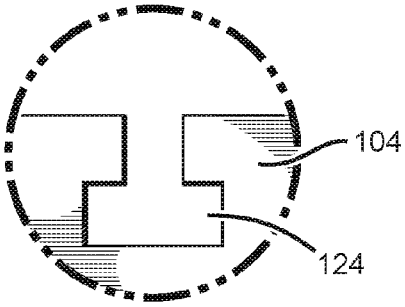
FIG. 1F
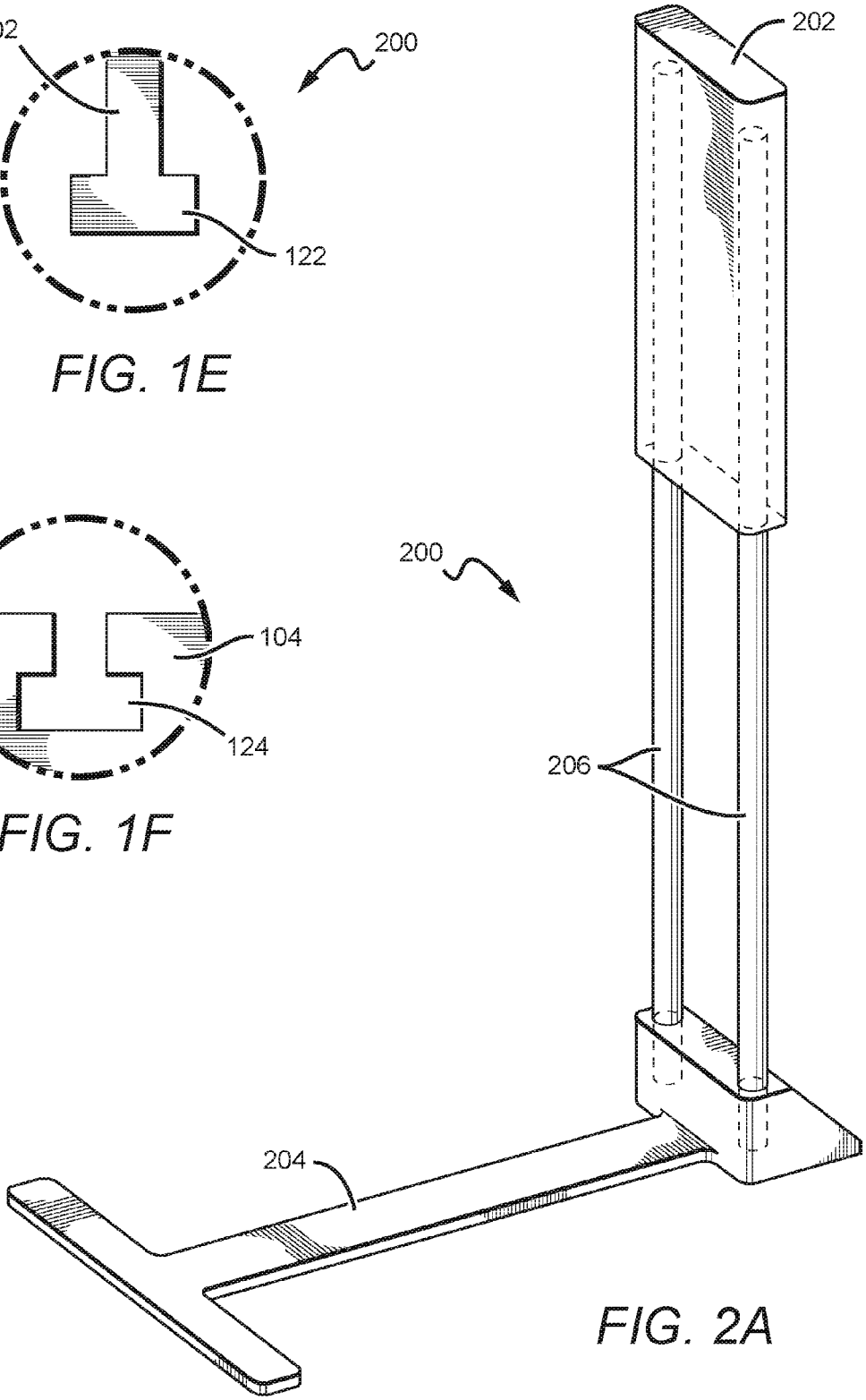
FIG. 2A

FIG. 2E
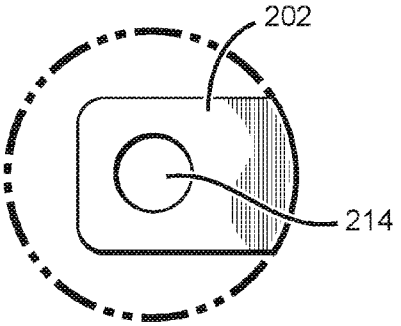
FIG. 2F
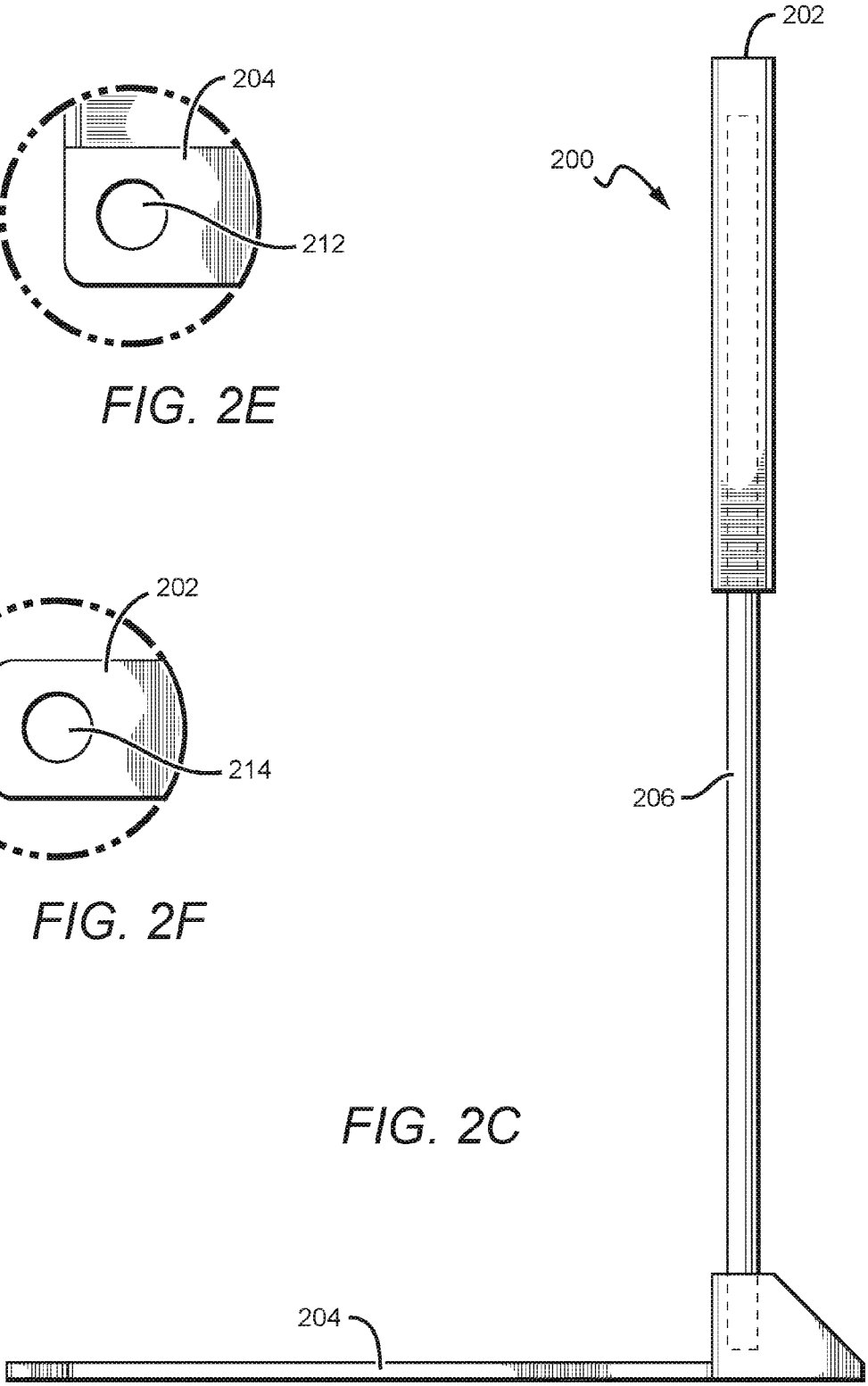
FIG. 2C

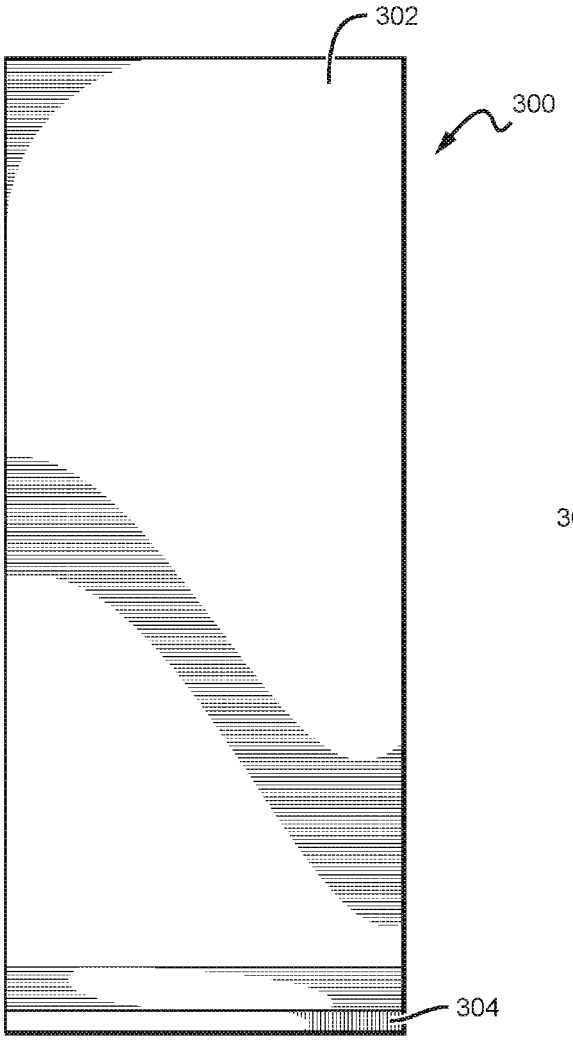
FIG. 3B
FIG. 3A
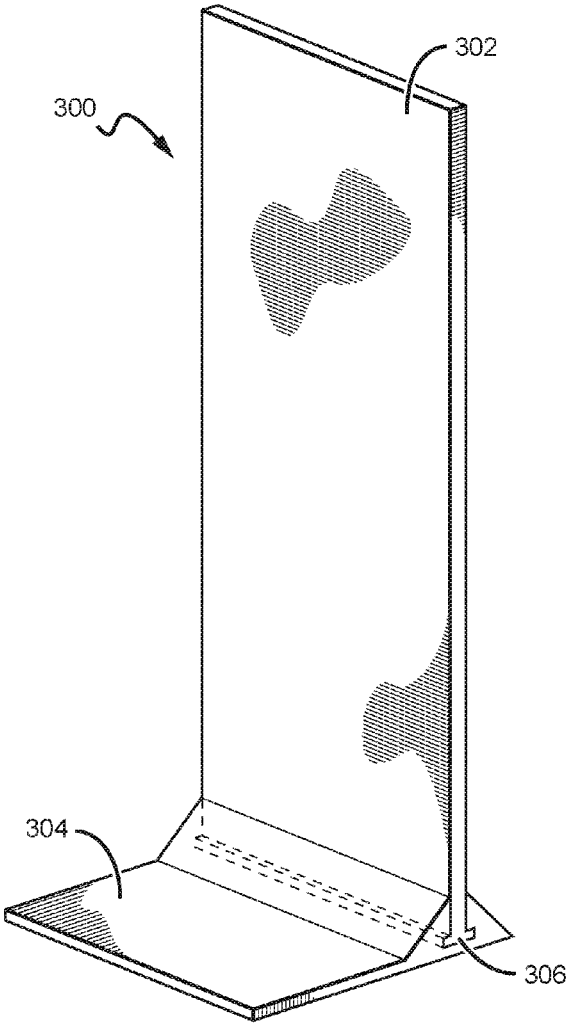

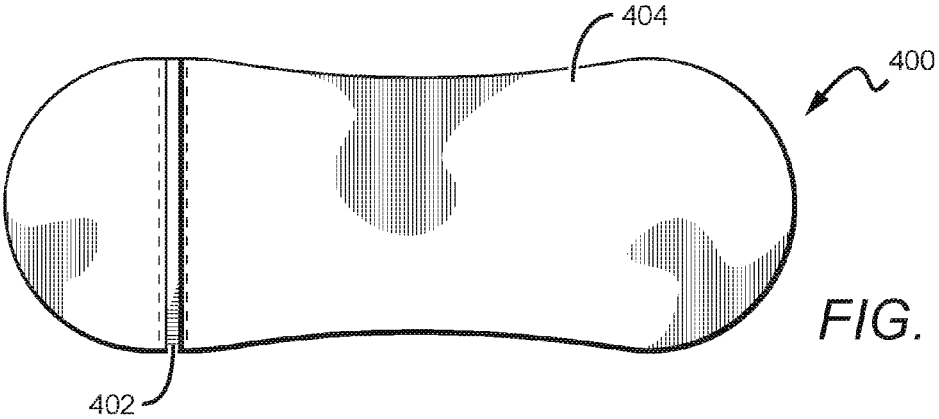
FIG. 4D
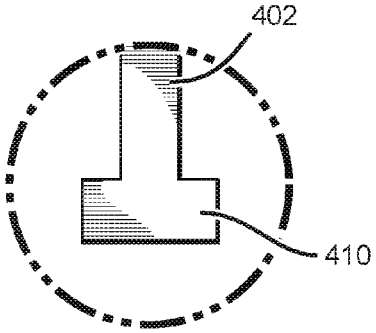
FIG. 4E
FIG. 4C
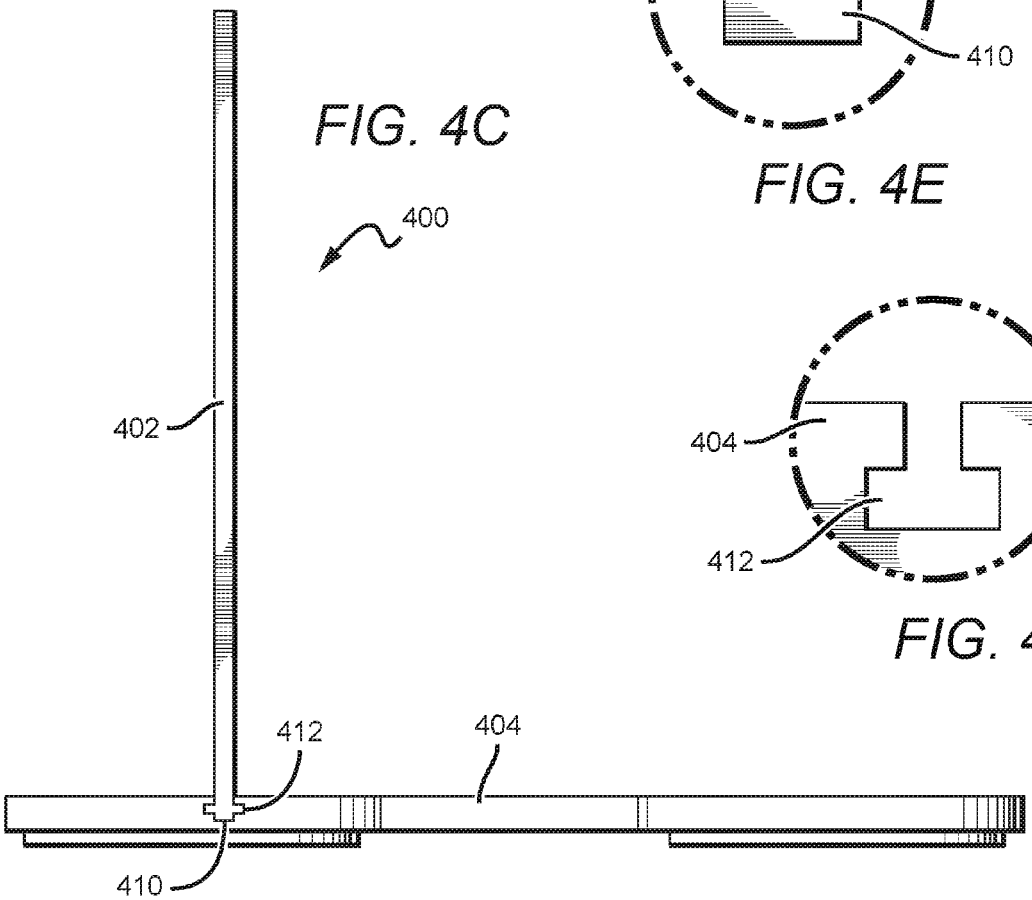
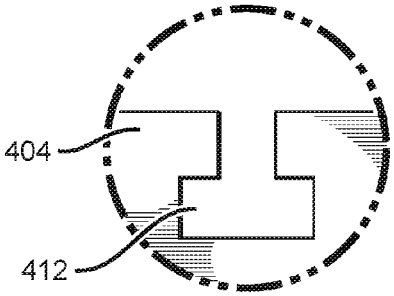
FIG. 4F

DEVICE TO ASSIST WITH STRETCHING

FIELD OF THE INVENTION

The field of the invention is stretching devices.

BACKGROUND

The following description includes information that may be useful in understanding the present invention. It is not an admission that any of the information provided in this application is prior art or relevant to the presently claimed invention, or that any publication specifically or implicitly referenced is prior art.

Stretching is an important part of exercise. Practitioners of yoga and other static movement based exercises place extra emphasis on the building of strength at the same time as improving flexibility. Flexibility is also important for other types of athletes. For example, hurdlers must have flexible legs and hips so that they can clear the hurdles while minimizing deviations from their normal forward momentum. Soccer, football, tennis, golf, and many others all require flexibility.

To keep some major muscle groups limber and flexible, oftentimes people will use a wall or other static vertical surface to facilitate stretching. Frequently, in the comfort of one's own home the only vertical surfaces available are painted walls where scuff marks from shoes or feet are undesirable. Ideally, one could stretch, for example, their hamstring muscles using a vertical surface without needing to put their leg up against a wall.

Efforts have been made to solve this problem in the past, each falling short in one way or another. In U.S. Pat. No. 6,203,473, a device is described that helps a person lying on the floor to stretch their hamstrings. But this device requires the user to hold onto two handles while in use, otherwise the device will fall down to the floor under the pressure of the user's leg.

In U.S. Pat. No. 7,762,936, a similar effort is made to facilitate hamstring stretching. But the device in this patent is so specialized as to diminish its usefulness for other types of stretches that require a vertical surface. As with the '473 patent, the device in this patent also requires users to use both hands to manipulate the device.

U.S. Patent Application No. 2013/0225378 describes a device that is designed to facilitate hamstring stretching from a lying down position. While this device creates a static component to stretch against, it fails to contemplate advantages enjoyed by a device that better simulates a static wall.

These and other efforts to create devices designed to facilitate leg stretching fail to consider advantages of simplicity, instead focusing on complex devices designed to stretch specific muscle groups. It would be advantageous to provide a simpler, more robust device.

All publications in this application are incorporated by reference to the same extent as if each individual publication or patent application were specifically and individually indicated to be incorporated by reference. Where a definition or use of a term in an incorporated reference is inconsistent or contrary to the definition of that term provided in this application, the definition of that term provided in this application applies and the definition of that term in the reference does not apply.

SUMMARY OF THE INVENTION

The inventive subject matter provides systems, methods, and apparatuses to facilitate stretching. Devices of the inventive subject matter include a stretching board having a coupling feature affixed to one end and a base board having another coupling feature. The coupling feature on the stretching board is sized and dimensioned to couple with the coupling feature on the base board to form a coupling angle (e.g., 90 degrees) between the stretching board and the base board. The stretching board can also have a first handle feature located between the two ends of the stretching board.

In another aspect of the inventive subject matter, another device to facilitate stretching exercises is contemplated. The device includes a stretching board with a coupling feature affixed to one end and a base board that also has a coupling feature affixed to it. The coupling feature on the stretching board is sized and dimensioned to receive a rod, and the coupling feature of the base board is also sized and dimensioned to receive the rod. Thus, the rod couples the base board to the stretching board at a coupling angle (e.g., 90 degrees) when the rod is inserted into both coupling features. A handle feature can also be located between two ends of the stretching board, and another handle feature can be located at an end of the stretching board to improve usability of the device.

In some embodiments: the stretching device can also include a handle feature located at an end of the stretching board; the base board can have a length that is 25%-75% of a length of the stretching board; the coupling feature of the base board can be affixed to an end of the base board; the coupling features of the base board and the stretching board can couple such that the stretching board is hingedly coupled with the base board; and the handle features can be slots in the stretching board.

Various objects, features, aspects and advantages of the inventive subject matter will become more apparent from the following detailed description of preferred embodiments, along with the accompanying drawing figures in which like numerals represent like components.

BRIEF DESCRIPTION OF FIGURES

FIG. 1E shows side detail view of a bottom portion of the stretching board in FIG. 1A.

FIG. 1F shows a side detail view of a portion of the base board in FIG. 1A.

FIG. 2A shows a perspective view of an embodiment of the stretching device having a stretching board and a base board coupled by two rods.

FIG. 2C shows a side view of the device in FIG. 2A.

FIG. 2E shows bottom detail view of a portion of the stretching board in FIG. 2A.

FIG. 2F shows a top detail view of a portion of the base board in FIG. 2A.

FIG. 3A shows a perspective view of another embodiment of the stretching device having a stretching board coupled with a base board.

FIG. 3B shows a front view of the device in FIG. 3A.

FIG. 4C shows a side view of the device in FIG. 4A.

FIG. 4D shows a top view of the device in FIG. 4A.

FIG. 4E shows side detail view of a bottom portion of the stretching board in FIG. 4A.

FIG. 4F shows a side detail view of a portion of the base board in FIG. 4A.

DETAILED DESCRIPTION

Figure 1A:
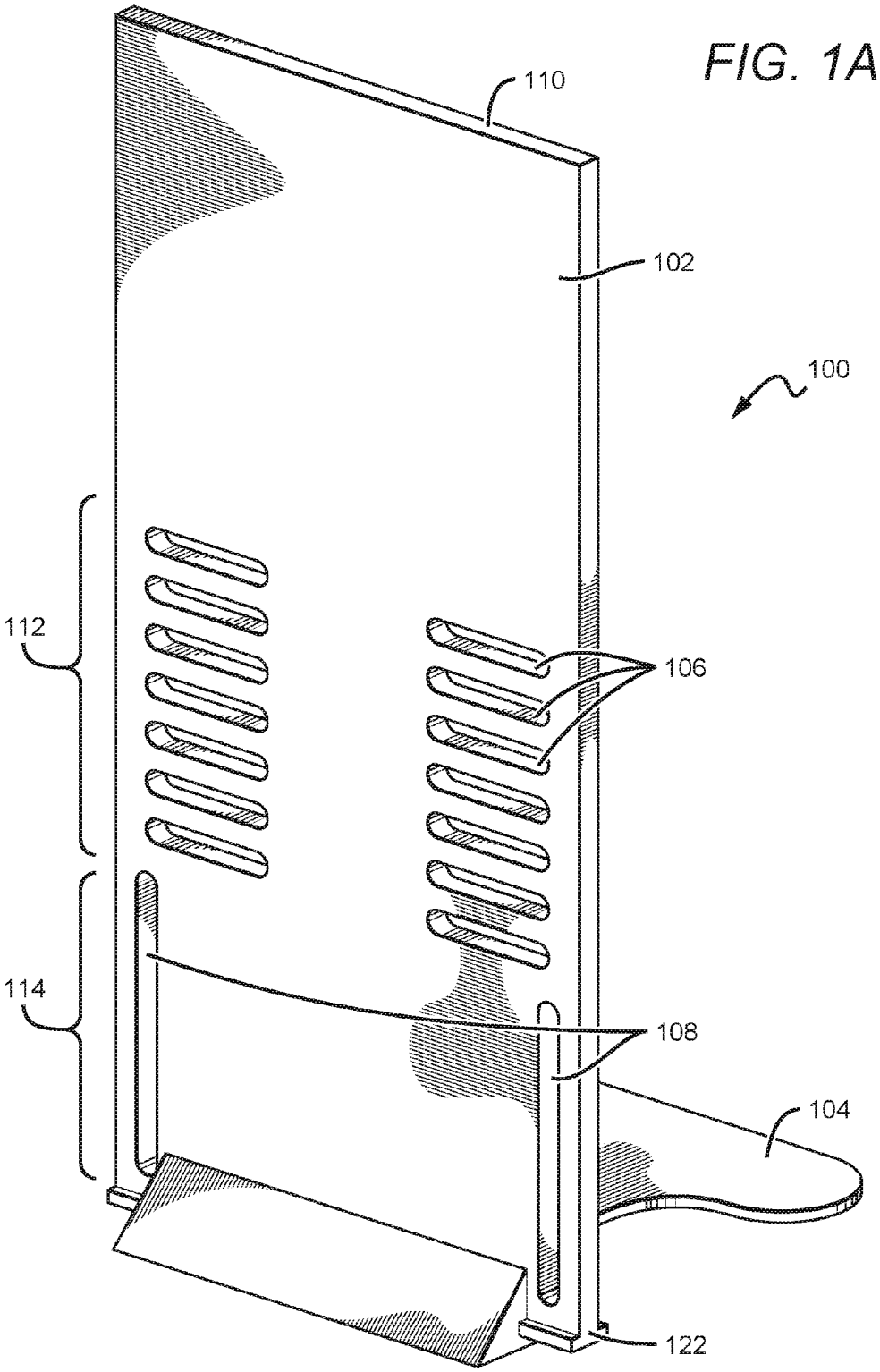
FIG. 1A shows a perspective view of an embodiment of the stretching device having a stretching board coupled with a base board.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

The recitation of ranges of values in this application is merely intended to serve as a shorthand method of referring individually to each separate value falling within the range. Unless otherwise indicated in this application, each individual value is incorporated into the specification as if it were individually recited in this application. All methods described in this application can be performed in any suitable order unless otherwise indicated in this application or otherwise clearly contradicted by context. The use of any and all examples, or exemplary language (e.g. "such as") provided with respect to certain embodiments in this application is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed in this application are not to be construed as limitations. Each group member can be referred to and claimed individually or in any combination with other members of the group or other elements found in this application. One or more members of a group can be included in, or deleted from, a group for reasons of convenience and/or patentability. When any such inclusion or deletion occurs, the specification is in this application deemed to contain the group as modified thus fulfilling the written description of all Markush groups used in the appended claims.

This application describes a stretching device designed to facilitate wall-based stretching without requiring a person to put their feet or shoes up on a wall, sparing the wall from scuff marks and grime. Wall based stretches include hamstring stretches where a person lies on their back with a leg up against a surface, or even just using a surface to help to balance while stretching another muscle group such as the quadriceps.

Figure 1B:
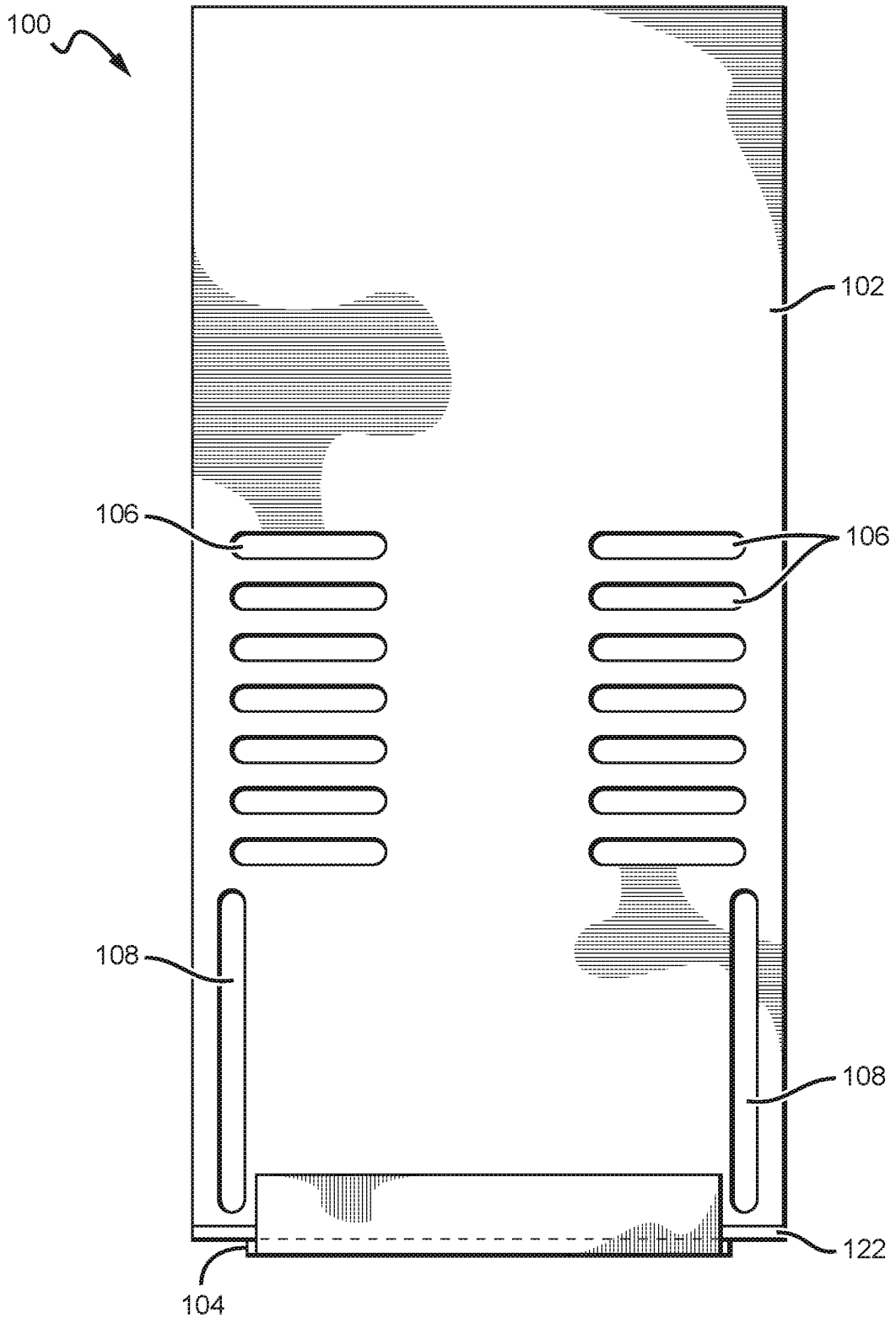
FIG. 1B shows a front view of the device in FIG. 1A.
Figure 1D:
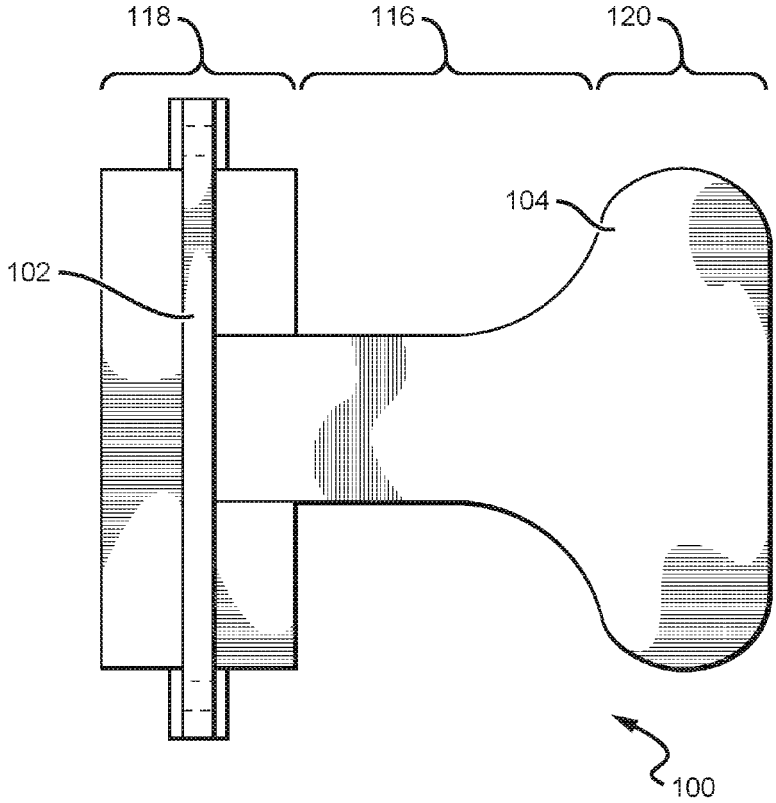
FIG. 1D shows a top view of the device in FIG. 1A.
Figure 1C:
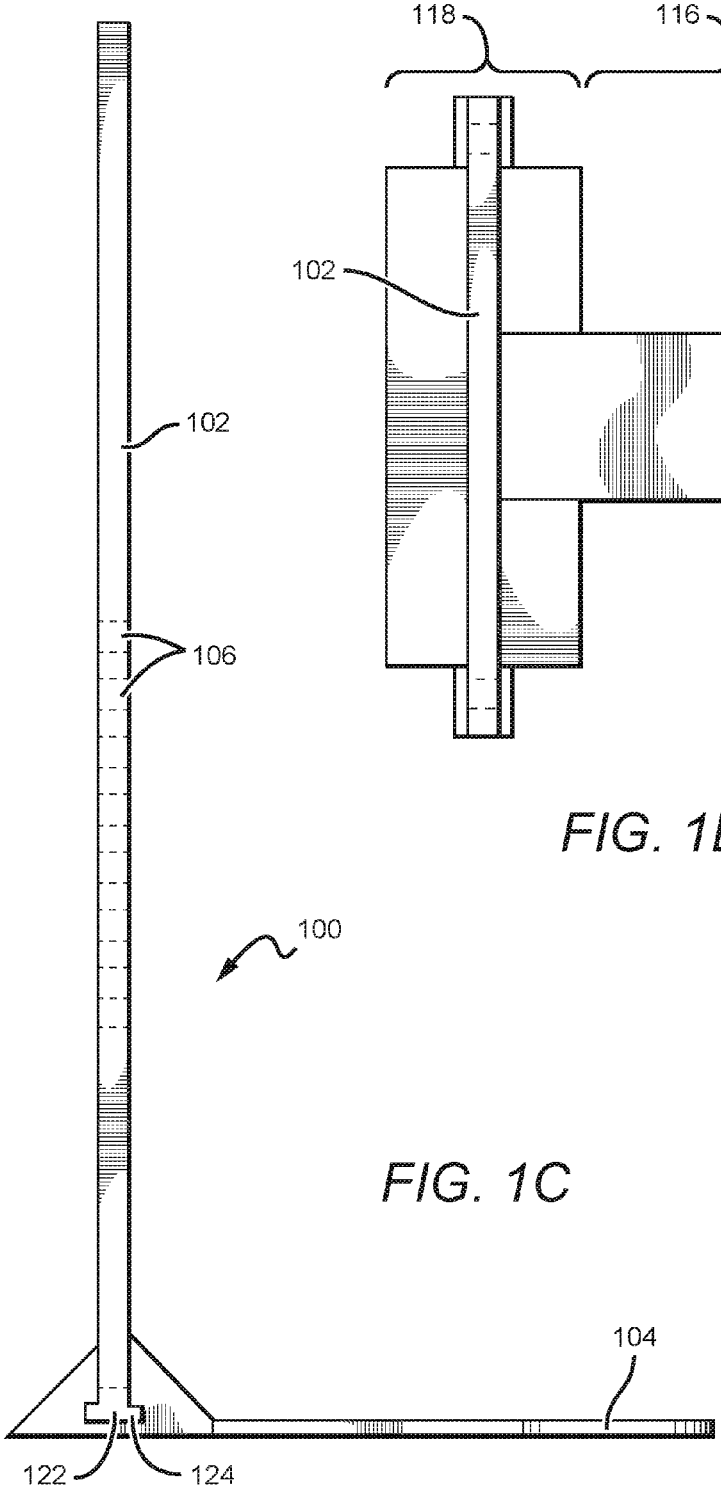
FIG. 1C shows a side view of the device in FIG. 1A.
Figure 2B:
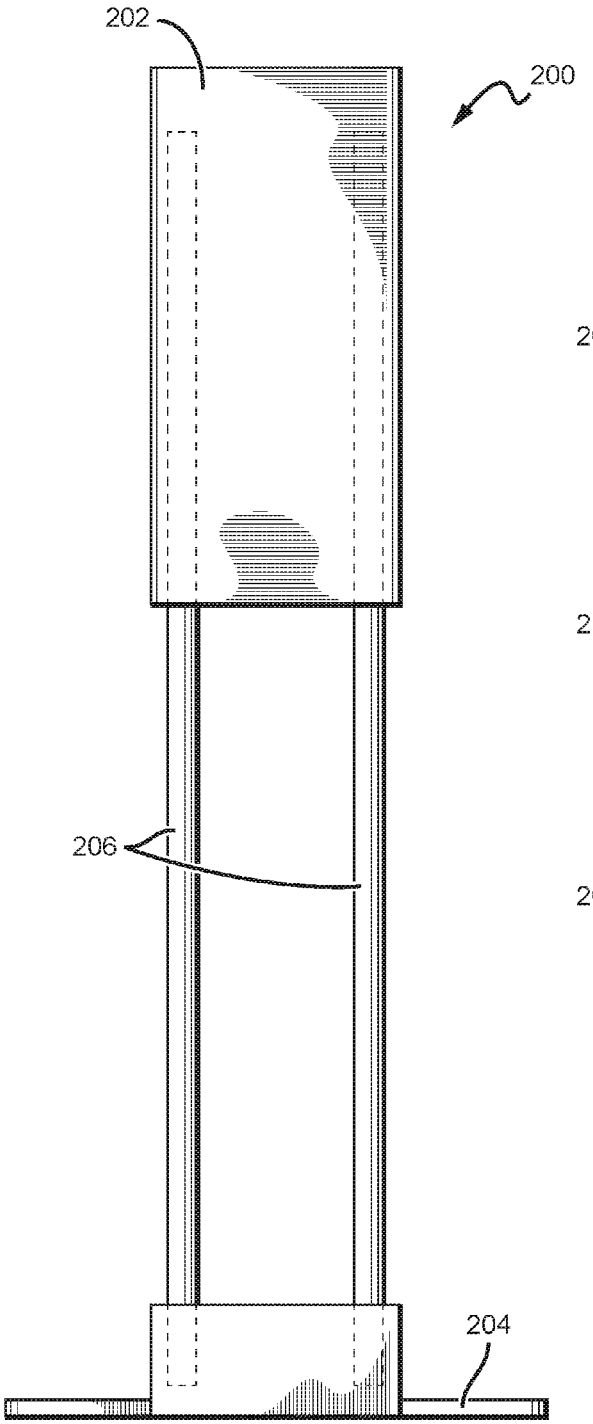
FIG. 2B shows a front view of the device in FIG. 2A.
Figure 2D:
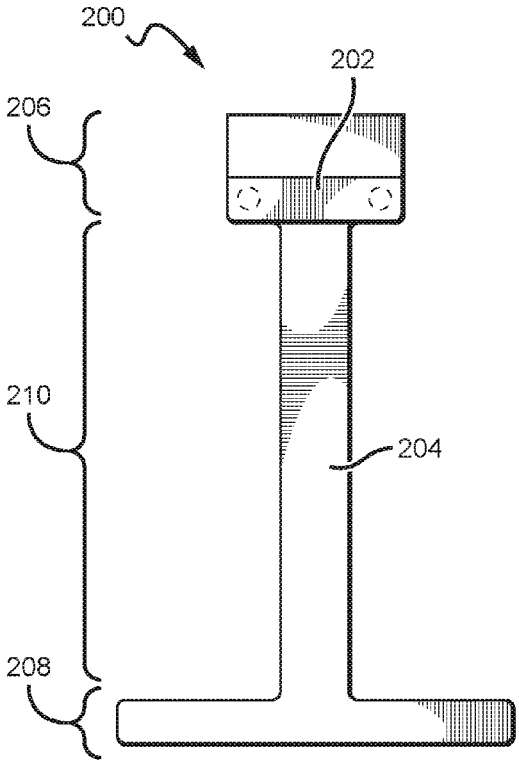
FIG. 2D shows a top view of the device in FIG. 2A.
Figure 3D:
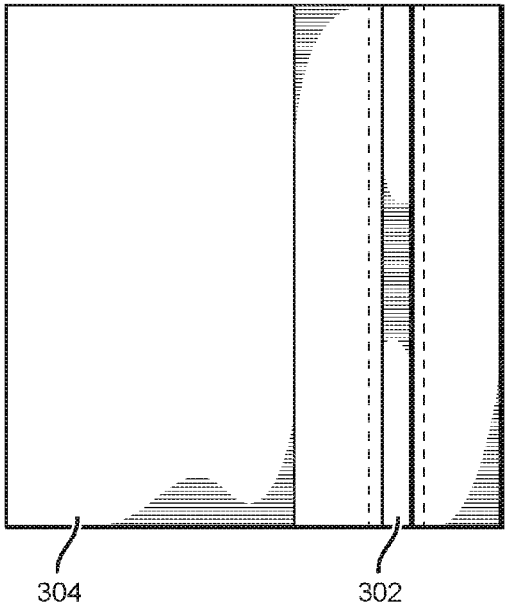
FIG. 3D shows a top view of the device in FIG. 3A.
Figure 3C:
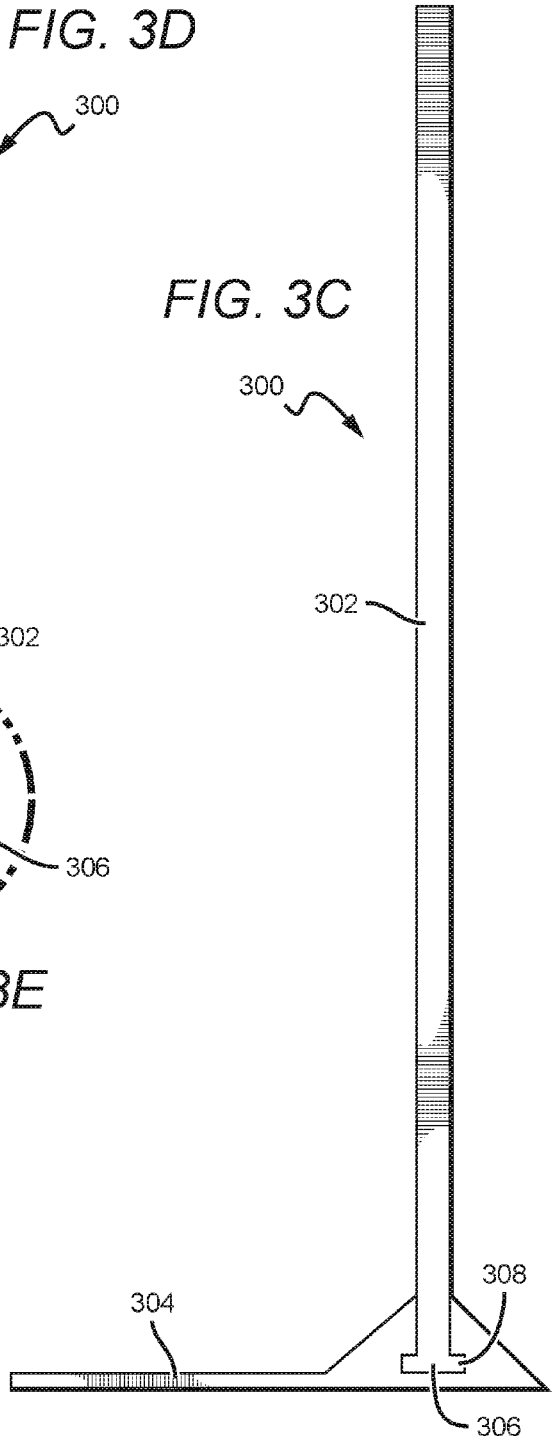
FIG. 3C shows a side view of the device in FIG. 3A.
Figure 3E:
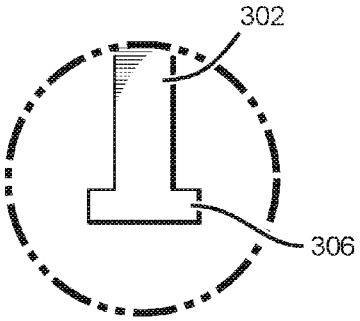
FIG. 3E shows side detail view of a bottom portion of the stretching board in FIG. 3A.
Figure 3F:
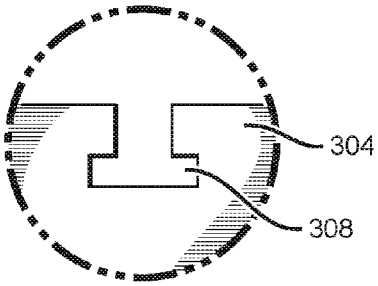
FIG. 3F shows a side detail view of a portion of the base board in FIG. 3A.
Figures 4A, 4B:
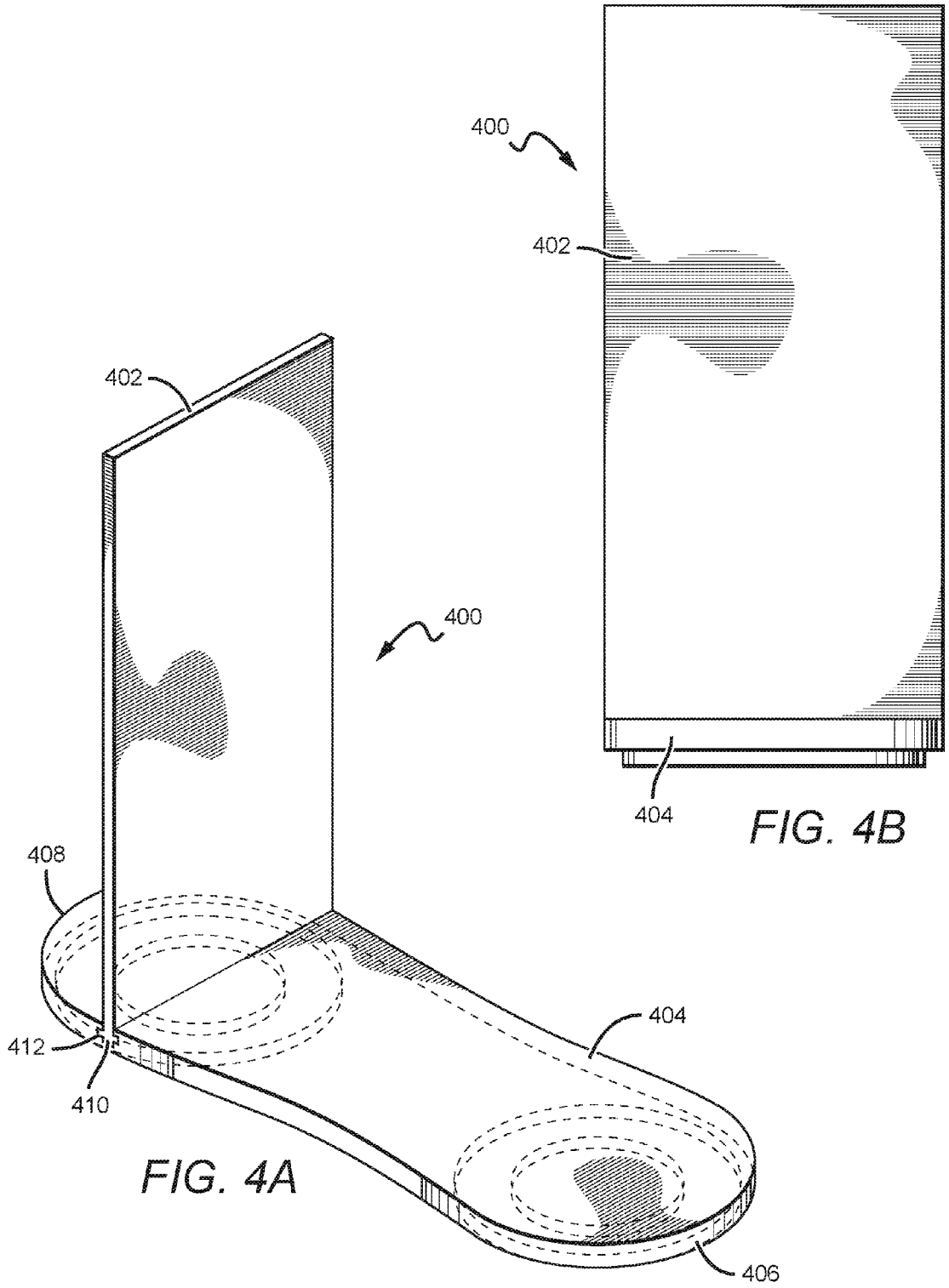
FIG. 4A shows a perspective view of another embodiment of the stretching device having a stretching board coupled with a base board.
FIG. 4B shows a front view of the device in FIG. 4A.

Stretching devices of the inventive subject matter include a stretching board that couples with a base board where the base board is designed to lie beneath a user's buttock or back while using the device. Examples of stretching devices can be seen in FIGS. 1A-4D. Each of these devices includes at least a stretching board and a base board, and the stretching board is cantilevered to the base board such that a user could lie on top of the base board while using the device (e.g., lying down to stretch a hamstring). The user's weight would help hold the device in place. Alternatively, the portion of the base board that extends away from the cantilevered stretching boards can provide a counteractive force to the force exerted by a user pressing against the stretching boards while the user lies flat on the side of the device opposite the direction that the base board extends.

Stretching boards of the inventive subject matter can also take on many different shapes and sizes. For example, the stretching boards 102, 202, 302, & 402 in FIGS. 1A-4D are all more or less rectangular. In the devices 100, 300, and 400 shown in FIGS. 1A-1D, 3A-3D, and 4A-4D, the stretching boards 102, 302, & 402 couple directly with the base boards 104, 304, & 404, necessitating larger stretching boards 102, 302, & 402 so that they extend far enough away from the base boards 104, 304, & 404 to enable a person to stretch, for example, a hamstring using the devices 100, 300, & 400.

A rectangular shape is not the only shape contemplated for the stretching board. It is important that at least some portion of the stretching board provide a flat surface for a user to press against (e.g., for a user's calf to press against while lying down to stretch the backs of their legs). Otherwise, the stretching board can take on almost any desired shape. In preferred embodiments, the stretching board provides a surface area of 100-120, 120-140, 140-160, 160-180, 180-200, 200-220, 220-240, 240-260, 260-280, 280-300, 300-320, 320-340, 340-360, 360-380, 380-400, 400-420, 420-440, 440-460, 460-480, 480-500, 500-520, 520-540, 540-560, 560-580, 580-600, 600-620, 620-640, 640-680, 680-700, 700-720, 720-740, 740-760, 760-78-, 780-800, 800-820, 820-840, 840-860, 860-880, 880-900, 900-920, 920-940, 940-960, 960-980, 980-1000, 1000-1020, 1020-1040, 1040-1060, 1060-1080, 1080-1100, 1100-1120, 1120-1140. 1140-1160, 1160-1180, 1180-1200, 1200-1220, 1220-1240, 1240-1260, 1260-1280, 1280-1300, or 1320-1340 inches squared.

Stretching boards can be made from a variety of different materials, including metals, plastics, and composites. In embodiments where the stretching boards are cantilevered to corresponding base boards, such as in FIGS. 1A-1D, 3A-3D, and 4A-4D, the required size, shape, and thickness of the stretching boards can depend on the material, on the shape, and on the tolerable amount of flexibility of the stretching board for a given embodiment. For example, plastic stretching boards would generally need to be thicker than stretching boards made from stiffer materials. Between two stretching boards—one plastic and one metal—that have the exact same bending tolerances, the plastic stretching board would need to either be thicker or include features to resist bending (e.g., thicker portions running the length of the stretching boards to increase structural integrity) to achieve the same amount of deflection for a constant applied force/pressure.

In other words, embodiments using wood or metal to form the stretching boards—both of which generally have higher Young's moduli than plastic—would not need to be as thick as comparable plastic stretching boards. It is contemplated that the stretching board material and dimensions should be selected such that a top edge of the stretching board does not deflect more than, for example 0.5-0.75, 0.75-1, 1-1.25, 1.25-1.5, 1.5-1.75, 1.75-2 inches from its initial position during normal use.

It is preferable for any embodiment of the inventive subject matter to have a lightweight stretching board. For embodiments of the device where the stretching boards are cantilevered to corresponding the base boards, such as those shown in FIGS. 1A-4D, the stretching boards are preferably lightweight and resistant to bending. Lightweight stretching boards make the stretching devices easier to assemble, disassemble, and transport, thereby improving usability of the device.

In some embodiments, the stretching board can include a coating ("coating" should be interpreted to include coverings as well). The coating can be, for example, rubber or plastic over another material (e.g., a metal, a wood, or a composite). A coating can increase the coefficient of friction of the stretching boards to prevent slippage during use. For example, if a person is stretching their hamstring by lying on their back with a leg up against the stretching boards, it can be beneficial to have a coating on the stretching boards that prevents the user's leg from slipping off.

A coating on a stretching board can also act as a cushion. In some embodiments, a stretching board can have a coating such as a gelatinous material, a neoprene (or neoprene-like) material, or other rubbers/rubber-like materials. These coatings can be applied in a variety of ways including by spray-on application, slip cover, adhesive, or any other appropriate type of fastener (e.g., screws, nails, etc.). Coatings as described above can also be applied to one or both sides of a stretching board.

FIGS. 1A-1D show an embodiment of the device where the stretching board 102 includes handle features 106 & 108 that facilitate use of the device 100 by, for example, making it easier for a user to reposition their body relative to the device 100. In situations where a user is lying down to use the device 100, it can be difficult for that user to reposition their body relative to the device 100, and the handles 106 & 108 make it easier for the user to scoot around while still lying down. Handles likes those shown in FIGS. 1A-1D could also be readily implemented in the embodiments shown in, for example, FIGS. 3A-3D and 4A-4D since those embodiments include a large, flat stretching boards 302 & 402.

Although the handles 106 & 108 shown in FIGS. 1A-1D are depicted as slots in the stretching board 102, it is also contemplated that the handles 106 & 108 could be implemented, for example, as grooves on the stretching board 102 or as handles that come out from the stretching board 102 to form a loop. Protruding loop-type handles can be flexible or rigid.

In embodiments having loop-type handles, the handles can protrude from one or more sides of a stretching board or from a surface of the stretching board. For example, on the embodiment shown in FIGS. 1A-1D, handles can be coupled with the top edge 110 of the stretching board 102 so that a person standing next to the device 100 can use the handles to assist with balance or to make it easier to move and reposition the device.

Handles 106 in some embodiments are located on a middle portion 112 of the stretching board 102. When located on a middle portion 112 of the stretching board 102, handles 106 can, for example, enable a person using the device 100 to increase a stretch by pulling their upper body up toward their legs when their legs are oriented vertically along the stretching board 102.

In other embodiments, handles 108 can be positioned on a lower portion 114 of the stretching board 102. Handles 108 positioned along a lower portion 114 of the stretching board 102 enable a person to reposition their body relative to the device 100 even from a lying down position. Being able to reposition one's body relative to the device makes it easier for a person to stretch different muscle groups or to affect the intensity of a stretch (by, e.g., changing the angle of a person's legs relative to their hips and upper body). Handles 108 located on a lower portion of the stretching board can be located at or near an edge of the stretching board. In some embodiments, one or more handles (or, e.g., slots) can be located in the center of the stretching boards 102, 302, & 402 within the lower portion such that a person, while lying down to use the machine, could reach between their legs to grab the handles.

It is contemplated that any of the handles on a stretching board can be coupled with (or built into, as the case may be) the stretching board at various angles. For example, handles can be oriented in relation to the bottom edge of a stretching board at any angle ranging from 0 to 90 degrees (e.g., 0-5, 5-10, 10-15, 15-20, 20-25, 25-30, 30-35, 35-40, 40-45, 45-50, 50-55, 55-60, 60-65, 65-70, 70-75, 75-80, 80-85, and 85-90 degree angles).

While force could be applied to either side of a stretching board of an embodiment of the device during use, all of the embodiments shown in FIGS. 1A-4D share one common feature: the base boards 104, 204, 304, & 404 are designed so that at least a portion can lie beneath a user's back/buttocks while the user lies down to use the device 100, 200, 300, & 400 to stretch. For example, in the embodiment in FIGS. 1A-1D, the base board 104 includes a narrow portion 116 with two wider portions 118 & 120 at either end of the narrow portion 116. The embodiment in FIGS. 2A-2D features a similar base board 204 having two wide portions 206 & 208 coupled by a narrow portion 210. This design can reduce the amount of material required to create the base board 204. The embodiment in FIGS. 3A-3D, on the other hand, features a base board 304 that is rectangular in shape. And the embodiment in FIGS. 4A-4D features a base board 404 having rounded ends 406 & 408.

Sizing and dimensioning base boards of the inventive subject matter as substantially flat pieces makes it easier for a user to lie on the base board without experiencing discomfort or having a difference in height between the floor and the base board interfere with stretching. The base board also provides stability for a coupled stretching board when it is deployed. In some embodiments, one or more portions of the base board are wider than other portions. Designs like this can increase stability of the stretching board when it is coupled with the base board to help prevent the device from tipping over.

Base boards of the inventive subject matter can be made from a wide variety of materials. For example, it is contemplated that base boards can be made from plastic, wood, metal, metal alloys, and composite materials (e.g., fiberglass/epoxy composites and composite materials made up from combinations of any of the other listed materials). It is contemplated that base boards of the inventive subject matter can be rigid to provide stability to the stretching device. Rigidity can be achieved using structural elements such as rods within the base board, but rigidity can also be achieved by virtue of the material that the base board is made from.

Base boards can have different weights. In some embodiments, it is preferable for the base board to weigh more than the stretching boards 102, 302, & 402. For example, the base board can weigh more than the stretching boards 102, 302, & 402 by: 10-20%, 20-30%, 30-40%, 40-50%, 50-60%, 60-70%, 70-80%, 80-90%, 90-100%, 100-110%, 110-120%, 120-130%, 130-140%, 140-150%, 150-160%, 160-170%, 170-180%, 180-190%, 190-200%. But the base board's weight does not necessarily need to be defined as a function of the weight of the stretching boards 102, 302, & 402. In some embodiments, the base board, irrespective of the stretching boards 102, 302, & 402, can weigh, for example, 10-20, 20-30, 30-40, 40-50, 50-60, and 60-70 pounds. These weight ranges are considered sufficient to improve stability.

Weight in the base board can be evenly distributed, but that is not necessary for all embodiments. In embodiments like those shown in FIGS. 1A-1D, 2A-2D, 3A-3D, and 4A-4D, weight in the base board 104, 204, 304, & 404 can be concentrated in the half of the base board 104, 204, 304, & 404 that the stretching boards 102, 202, 302, & 402 couples with. Weight in the base board 104, 204, 304, & 404 can also be concentrated in the other half of the base board 104, 204, 304, & 404. In still further embodiments, weight can be concentrated in both halves of the base board 104, 204, 304, & 404 in varying ratios. Ratios of weight concentration between the two halves of base boards of the inventive subject matter can be, for example, 1:10, 1:9, 1:8, 1:7, 1:6, 1:5, 1:4, 1:3, 1:2, and 1:1.

Base boards of the inventive subject matter, like stretching boards 102, 202, 302, & 402 described above, can include a soft material covering or coating. Since users will be standing, kneeling, lying, and otherwise resting bodyweight on the base boards of some embodiments of the contemplated stretching devices, it can be advantageous for the base board to be soft. By covering or coating the base board with, for example, a rubber, neoprene material, or gelatinous material, a stretching device user would be more comfortable than if a user were required to rest their body on In some embodiments, the base board is designed such that a portion of the base board can be positioned beneath a user's lumbar. For example, in FIGS. 1A-1D, a portion 120 could be positioned beneath a user's lumbar while the user lies down to stretch their hamstrings, for example using the stretching device 100. In this embodiment, the portion 120 of the base board 104 that is located beneath that user's lumbar during use of the stretching device 100 could be cushioned such that it conforms to the curve of the user's spine.

In some embodiments, the stretching board can couple directly to the base board. For example, in FIGS. 1A-1D, 3A-3D, and 4A-4D, the stretching boards 102, 302, & 402 include key-like features 122, 306, & 410 (i.e., a coupling feature) while the base boards 104, 304, & 404 include a corresponding slot feature 124, 308, & 412. These coupling features are seen best in FIGS. 1E-1F, 3E-3F, and 4E-4F. The stretching boards 102, 302, & 402 can be slid into place such that the key-like features 122, 306, & 410 of the stretching boards 102, 302, & 402 fit within the slot features 124, 308, & 412 of the base boards 104, 304, & 404 without requiring a fastener. This design facilitates simple assembly and disassembly. It is also contemplated that the base boards 104, 304, & 404 could have the key-like feature and the stretching boards 102, 302, & 402 could have the slot features.

In other embodiments, such as the embodiment shown in FIGS. 2A-2D, the base board 204 can be coupled with the stretching board 202 by one or more rods 206. Rods 206 provide structural rigidity as they are inserted into slots 212 & 214 on the base board 204 and also into similar slots in the stretching board 202. Slots 212 & 214 can be seen best in FIGS. 2E-2F, which are detail views of the base board 204 and the stretching board 202, respectively. Rods 206 can be made from, for example, metal, plastic, wood, or any type of composite material.

In some embodiments, a stretching board can be fastened to a base board using screws or other fasteners known in the art. While each of the embodiments shown in FIGS. 1A-5D show the stretching board 102, 202, 302, 402, & 502 coupled to the base board 104, 204, 304, 404, & 504 such that the two components form a 90 degree angle to each other, it is contemplated that the stretching boards and base boards of other embodiments can be coupled together such that the angle between the two components can be adjustable or fixed in angles other than 90 degrees. For example, it is contemplated that the angle between the stretching boards can form an angle from 45-135 degrees with the base board. Being able to couple the stretching board to the base board at different fixed angles or adjustable angles can be beneficial for users having different levels of flexibility.

It should be apparent to those skilled in the art that many more modifications besides those already described are possible without departing from the inventive concepts in this application. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device to facilitate stretching exercises, comprising:

a stretching board having a key-like feature affixed to an entire length of a first end of the stretching board;

a base board having a slot feature;

wherein the key-like feature is sized and dimensioned to couple with the slot feature to form a coupling angle between the stretching board and the base board such that the stretching board is cantilevered to the base board; and the stretching board further comprising a first handle feature located between the first end and a second end of the stretching board.

2. The device of claim 1, further comprising a second handle feature located at the second end of the stretching board.

3. The device of claim 1, wherein a length of the base board is 25%-75% of a length of the stretching board.

4. The device of claim 1, wherein the slot feature is affixed to the base board near an end of the base board.

5. The device of claim 1, wherein the base board weighs 20-30 pounds.

6. The device of claim 1, wherein the first handle feature comprises a slot in the stretching board.

7. The device of claim 1, wherein the coupling angle is 90 degrees.

8. The device of claim 1, wherein the base board weighs 30-40 pounds.

9. The device of claim 1, wherein the base board weighs 40-50 pounds.

10. The device of claim 1, wherein the base board weighs 50-60 pounds.

* * * * *